US008567941B2

(12) United States Patent
Sano et al.

(10) Patent No.: US 8,567,941 B2
(45) Date of Patent: Oct. 29, 2013

(54) TRANSPORTING DEVICE AND IMAGE RECORDING APPARATUS INCLUDING THE SAME

(75) Inventors: Iwane Sano, Nagoya (JP); Yasuhira Ota, Yatomi (JP); Naokazu Tanahashi, Nagoya (JP); Shota Iijima, Nagoya (JP); Shingo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 429 days.

(21) Appl. No.: 13/073,804

(22) Filed: Mar. 28, 2011

(65) Prior Publication Data

US 2011/0291347 A1 Dec. 1, 2011

(30) Foreign Application Priority Data

May 31, 2010 (JP) ..... 2010-124454

(51) Int. Cl.
*B41J 2/01* (2006.01)

(52) U.S. Cl.
USPC ..... 347/104; 347/101

(58) Field of Classification Search
None
See application file for complete search history.

(56) References Cited

U.S. PATENT DOCUMENTS

| | | | | |
|---|---|---|---|---|
| 5,629,529 | A | 5/1997 | Motoyama | |
| 7,073,880 | B2 * | 7/2006 | Takahashi et al. | 347/16 |
| 7,401,879 | B2 * | 7/2008 | Isono et al. | 347/16 |
| 2003/0234852 | A1 * | 12/2003 | Oshima et al. | 347/104 |
| 2004/0017459 | A1 * | 1/2004 | Kawaguchi et al. | 347/104 |
| 2004/0141787 | A1 * | 7/2004 | Inokuchi et al. | 400/582 |
| 2006/0112845 | A1 | 6/2006 | Ouchi | |
| 2006/0170750 | A1 * | 8/2006 | Takeshita et al. | 347/104 |
| 2006/0181566 | A1 * | 8/2006 | Miyashita et al. | 347/20 |
| 2006/0237894 | A1 * | 10/2006 | Nagasaki et al. | 271/10.01 |
| 2007/0025794 | A1 * | 2/2007 | Kubin et al. | 400/605 |
| 2007/0036606 | A1 * | 2/2007 | Takeshita et al. | 400/642 |
| 2007/0058024 | A1 * | 3/2007 | Miyake et al. | 347/104 |

(Continued)

FOREIGN PATENT DOCUMENTS

| | | | |
|---|---|---|---|
| CN | 1443650 | A | 9/2003 |
| CN | 1781708 | A | 6/2006 |
| CN | 101462651 | A | 6/2009 |
| CN | 101715035 | A | 5/2010 |
| EP | 2002984 | A1 | 12/2008 |

(Continued)

OTHER PUBLICATIONS

The State Intellectual Property Office of the People's Republic of China, Notification of the First Office Action for Chinese Patent Application No. 201110082456.3 (counterpart Chinese patent application), issued Apr. 2, 2013.

*Primary Examiner* — Laura Martin
*Assistant Examiner* — Leonard S Liang
(74) *Attorney, Agent, or Firm* — Baker Botts L.L.P.

(57) ABSTRACT

There is provided a transporting device transporting a medium, including: a first member pair which changes a posture of the first member pair between a first posture and a second posture; a second member pair which changes a posture of the second member pair between a third posture and a fourth posture; and a movable member which is movable between a fifth posture and a sixth posture, and which has a first abutting portion and a second abutting portion, wherein, in a process that the movable member moves from the fifth posture to the sixth posture, the first abutting portion makes the first member pair change the posture from the first posture to the second posture, and while the first abutting portion makes the first member pair change the posture, the second abutting portion abuts on one of the second member pair.

18 Claims, 9 Drawing Sheets

(56) References Cited

U.S. PATENT DOCUMENTS

| | | | | |
|---|---|---|---|---|
| 2007/0058026 | A1* | 3/2007 | Miyake et al. | 347/104 |
| 2009/0322844 | A1* | 12/2009 | Komuro et al. | 347/104 |
| 2010/0045726 | A1 | 2/2010 | Nakajima et al. | |
| 2010/0050193 | A1* | 2/2010 | Takikawa et al. | 720/601 |
| 2010/0078872 | A1 | 4/2010 | Asada et al. | |
| 2011/0236118 | A1* | 9/2011 | Ota et al. | 400/642 |
| 2011/0242246 | A1* | 10/2011 | Ota et al. | 347/104 |

FOREIGN PATENT DOCUMENTS

| | | | | |
|---|---|---|---|---|
| JP | H07-277550 | A | | 10/1995 |
| JP | 2003-094740 | A | | 4/2003 |
| JP | 2006-088654 | A | | 4/2006 |
| JP | 2007118440 | A | * | 5/2007 |
| JP | 2007-136802 | A | | 6/2007 |
| JP | 2010-046935 | A | | 3/2010 |
| JP | 2010-070363 | A | | 4/2010 |

* cited by examiner

TRANSPORTING DEVICE AND IMAGE RECORDING APPARATUS INCLUDING THE SAME

CROSS REFERENCE TO RELATED APPLICATION

The present application claims priority from Japanese Patent Application No. 2010-124454, filed on May 31, 2010, the disclosure of which is incorporated herein by reference in its entirety.

BACKGROUND OF THE INVENTION

1. Field of the Invention

The present invention relates to a transporting device capable of transporting two types of media which are different from each other in thickness, and an image recording apparatus which includes this transporting device.

2. Description of the Related Art

Conventionally, a transporting device transporting a transportation-objective medium (medium to be transported) is provided. This transporting device is used for an image recording apparatus such as a printer or a multifunction machine which includes printing, scanning, and copying functions and so on. This image recording apparatus includes the above-described transporting device, a recording section recording an image to the transportation-objective medium which is transported by this transporting device, and a casing which accommodates or houses the recording section and the transporting device.

Some transporting devices include a transporting path expanding section expanding a transporting path to thereby make it possible to transport, in addition to a recording paper (recording sheet), etc. as the transportation-objective medium, another transportation-objective medium such as a medium tray, etc. on which a CD, a DVD or the like is placed. In these transporting devices, the transporting path is formed by a plurality of pairs of members such as a transporting roller pair, a paper discharging roller pair, and a platen and a recording head which face each other. One member in each of the member pairs is configured to change posture thereof. The transporting path expanding section includes an operating lever which is exposed outside a casing and a drive transmitting device which transmits a motion of the operating lever to the above-described one member of each of the member pairs; and as a result that the operating lever is operated by a user, the above-described one member of each of the member pairs is made to be away from the other member of the pair, thereby expanding the transporting path.

In these transporting devices, since posture change of a plurality of members is started simultaneously by one operating lever, there is a problem that an operating load of the operating lever is large, which results in poor usability. Further, in a case where a motor is used instead of the operating lever, restriction on a specification of the motor regarding a torque becomes severe. Therefore, in a transporting device which includes a transporting path expanding section, it is desired to reduce a force to move a movable member which is displaced by an operating lever, a motor or the like.

SUMMARY OF THE INVENTION

Aspects of the present invention are made in view of the above-described problem, and an object thereof is to provide a transporting device capable of reducing a force to move a movable member which makes a member forming a transporting path perform posture change, and an image recording apparatus which includes this transporting device.

According to a first aspect, there is provided a transporting device transporting a medium, including: a first member pair which is apart from each other with a distance in a first direction, and which faces each other to define a part of a transporting path through which the medium is transported, and which changes a posture of the first member pair between a first posture and a second posture in which the distance is different from the distance in the first posture; a second member pair which is apart from each other with a distance in the first direction, which faces each other in a position different from that of the first member pair to define a part of the transporting path, and which changes a posture of the second member pair between a third posture and a fourth posture in which the distance is different from the distance in the third posture; and a movable member which is movable between a fifth posture and a sixth posture along a second direction intersecting the first direction, and which has a first abutting portion which abuts on one of the first member pair and a second abutting portion which abuts on one of the second member pair, wherein, in a process that the movable member moves from the fifth posture to the sixth posture, the first abutting portion abuts on one of the first member pair and makes the first member pair change the posture from the first posture to the second posture, thereby generating a force in a direction opposite to a direction of movement from the fifth posture to the sixth posture, and wherein, while the first abutting portion makes the first member pair change the posture, the second abutting portion abuts on one of the second member pair and makes the second member pair change the posture from the third posture to the fourth posture, thereby generating a force in a same direction as the direction of movement from the fifth posture to the sixth posture.

With regard to the forces the movable member receives from both of the first member pair and the second member pair, a part of the force received from the first member pair and a part of the force received from the second member pair balance out, and a resultant force of the force acting on the movable member is reduced. As a result, the user can easily move the movable member.

The second abutting portion may be disposed in the movable member so that the second abutting portion abuts on one of the second member pair in the process that the movable member moves from the fifth posture to the sixth posture and when the force generated by the first abutting portion has a maximum value. By the constitution, the second member pair performs posture change when the force the movable member receives from the first member pair is the maximum, thereby the maximum value of the force to move the movable member can be reduced.

The first abutting portion may include a first inclined surface which intersects the second direction and which abuts on one of the first member pair in the process that the movable member moves from the fifth posture to the sixth posture; and the second abutting portion may include a second inclined surface which intersects the second direction and is contrary to the first inclined surface in terms of a direction of a surface, and which abuts on one of the second member pair in the process. Thereby, there is realized a transporting device capable of reducing a force to move the movable member, by a simple constitution as the inclined surfaces.

The first member pair may include a first moving member which changes a posture and a first fixed member which is fixed in a moving direction of the first moving member; the second member pair may include a second moving member which changes a posture and a second fixed member which is fixed in a moving direction of the second moving member; the first inclined surface may be disposed in a first fixed member side of the first moving member; and the second inclined surface may be disposed in a side opposite to a second fixed member side of the second moving member. The transporting device may include a first biasing member which biases the first moving member to the first fixed member side, in a state where the first moving member abuts on the first inclined surface; and a second biasing member which biases the second moving member to the second fixed member side, in a state where the second moving member abuts on the second inclined surface.

By using the first biasing member which presses the first movable member to the first fixed member, and the second biasing member which presses the second movable member to the second fixed member, the first moving member and the second moving member can be respectively pressed to the first inclined surface and the second inclined surface which are provided in a manner that directions of incline are contrary to each other. As a result, it is possible to realize a transporting device capable of reducing the force to move the movable member, with a small number of components.

According to a second aspect, there is provided a transporting device transporting a medium, including: a first member pair which is apart from each other with a distance in a first direction, and which faces each other to define a part of a transporting path through which the medium is transported, and which changes a posture of the first member pair between a first posture and a second posture in which the distance is different from the distance in the first posture; a second member pair which is apart from each other with a distance in the first direction, which faces each other in a position different from that of the first member pair to define apart of the transporting path, and which changes a posture of the second member pair between a third posture and a fourth posture in which the distance is different from the distance in the third posture; and a movable member which is movable between a fifth posture and a sixth posture and which has a first abutting portion which abuts on one of the first member pair and a second abutting portion which abuts on one of the second member pair, wherein, in a process that the movable member moves from the fifth posture to the sixth posture, the first abutting portion abuts on one of the first member pair and makes the first member pair change the posture from the first posture to the second posture, and wherein, after the first abutting portion makes the first member pair change the posture from the first posture, the second abutting portion abuts on one of the second member pair and makes the second member pair change the posture from the third posture.

The second member pair may start to perform posture change from the third posture after the first member pair performs posture change from the first posture. Consequently, the force which acts on the movable member is dispersed in terms of time, thereby the force to move the movable member is reduced, which enables the user to move the movable member easily.

The second abutting portion may be disposed in the movable member so that the second abutting portion abuts on one of the second member pair in the process that the movable member moves from the fifth posture to the sixth posture and after the first member pair changes the posture to the second posture. The second abutting portion can be provided in the movable member so that the second abutting portion abuts on the second member pair before the first member pair completes posture change, but it is desirable that the second abutting portion is provided in the movable member at a position so that the second abutting portion is capable of abutting on the second abutting portion after the first abutting portion completes posture change. It is because an effect to reduce the force to move the movable member can be heightened.

The first abutting portion and the second abutting portion may be provided integrally with the movable member; and when the movable member is in the fifth posture, a first distance from the first abutting portion along a moving direction of the movable member in relation to the first member pair in the first posture may be smaller than a second distance from the second abutting portion along the moving direction in relation to the second member pair in the third posture. By a simple constitution as a positional relationship between the first abutting portion and the second abutting portion along the moving direction, the force which acts on the movable member is dispersed in terms of time, whereby the force to move the movable member can be reduced.

The first abutting portion, when making the first member pair change the posture from the first posture, may generate a force in a direction opposite to a direction of movement of the movable member from the fifth posture to the sixth posture, and the second abutting portion, when making the second member pair change the posture from the third posture, may generate a force in a direction opposite to the direction of the movement. Since the first abutting portion and the second abutting portion generate components of the forces in the same direction, the first abutting portion and the second abutting portion can have similar constitutions, which enables to simplify constitutions. In other words, it is possible to realize a transporting device which has a simple constitution and which is capable of reducing a force to move a movable member.

The movable member may move in a second direction intersecting the first direction; the first abutting portion may include a first inclined surface which intersects the second direction and which makes the first member pair change the posture by abutting on one of the first member pair by the movement of the movable member; and the second abutting portion may include a second inclined surface which intersects the second direction and which makes the second member pair change the posture by abutting on one of the second member pair by the movement of the movable member. The movement of the movable member in the second direction is changed to a movement in the first direction by a simple constitution as the inclined surfaces, thereby the first member pair and the second member pair can perform posture change.

The transporting device of the present teaching may further include a grip portion which is provided in one end side of the movable member. Thereby, there is realized a transporting device which make the user move the movable member easily.

The transporting device of the present teaching may further include a drive source to move the movable member. Since a force to move the movable member can be reduced as described above, in the constitution in which the movable member is moved by the drive source, restriction on a specification of the drive source regarding a torque is alleviated.

According to a third aspect, there is provided an image recording apparatus including: the transporting device according to the first aspect or the second aspect; and a recording section which records an image to the medium transported through the transporting path. It is possible to realize an image recording apparatus which is capable of reducing a force to move a movable member.

According to the aspects of the present invention, in a transporting device which expands a transporting path by making the above-described plural member pairs perform posture change and in an image recording apparatus which includes this transporting device, a force to move the movable member can be reduced.

DETAILED DESCRIPTION OF THE PREFERRED EMBODIMENT

[First Embodiment]

Figure 1:
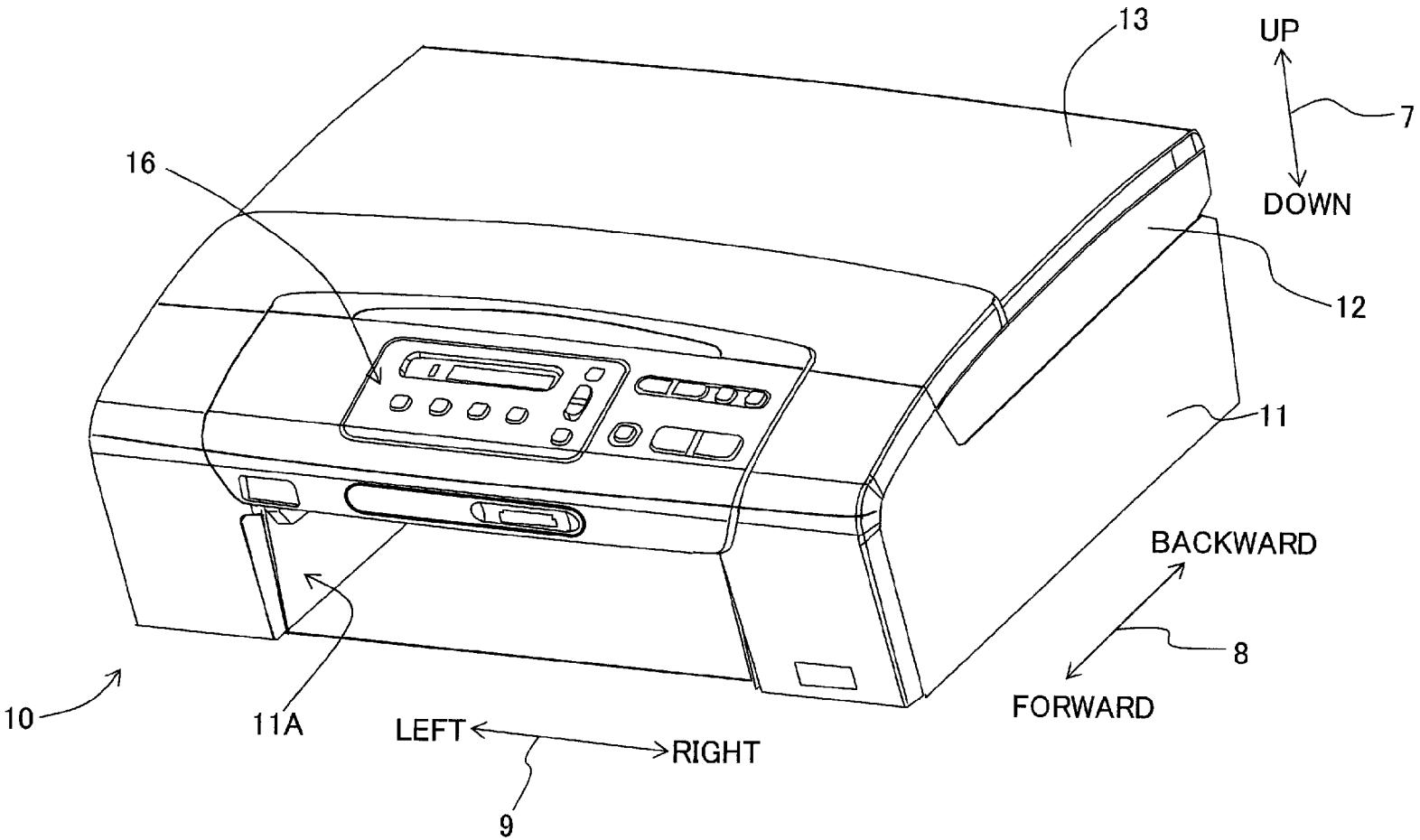
FIG. 1 is a perspective view of a multifunction machine.

Hereinafter, as a preferred embodiment of an image recording apparatus, a multifunction machine 10 of FIG. 1 which includes scanning, printing, copying and faxing functions will be explained. It should be noted that a height direction of the multifunction machine 10 whose outer shape is formed in a rectangular parallelepiped shape is defined as an up and down direction 7, a depth direction is defined as a forward and backward direction 8, and a width direction is defined as a right and left direction 9, and then the following explanation will be done.

[Overview of Multifunction Machine 10]

The multifunction machine 10 includes a printer casing 11, a scanner casing 12 mounted on an upper surface of the printer casing 11, and an original cover 13 mounted on an upper surface of the scanner casing 12. The original cover 13 is supported by the scanner casing 12 in an openable/closable manner, and sandwiches an original with the scanner casing 12 by being opened/closed. An image of the original is scanned and taken in by a not-shown scanner such as a flatbed scanner housed in the scanner casing 12. The scanner casing 12 housing the scanner is supported by the printer casing 11 in an openable/closable manner.

The printer casing 11 includes in its lower portion a recess 11A which houses a paper feeding cassette 14 and supports the paper feeding cassette 14 in a drawable manner. The paper feeding cassette 14 is drawn from the printer casing 11 by a user and a first recording medium 19 being recording paper or the like is placed thereon. An image is recorded to the first recording medium 19 by a printer section 15 housed in the printer casing 11.

Control of the printer section 15 and the above-described scanner is performed by a control section. The control section is realized by a variety of electronic components such as a microcomputer mounted on a control board. A signal is inputted to the control section from an external apparatus such as a control panel 16 of FIG. 1 installed in the printer casing 11 or a personal computer, and by the inputted signal, the control section drives the scanner, transmits an image which is taken in by the scanner to a personal computer or a telephone line, or makes the image which is taken in by the scanner or an image which is inputted from the personal computer or the telephone line recorded to the first recording medium 19 or a second recording medium. The second recording medium is a CD or a DVD and is placed on a not-shown tray. The tray is formed, for example, in a plate shape with a thickness of several mm which includes a circular recess into which the second recording medium is fit. The tray is placed by the user in a later-described tray guide 45 which the printer section 15 includes.

[Printer Section 15]

Figure 2:
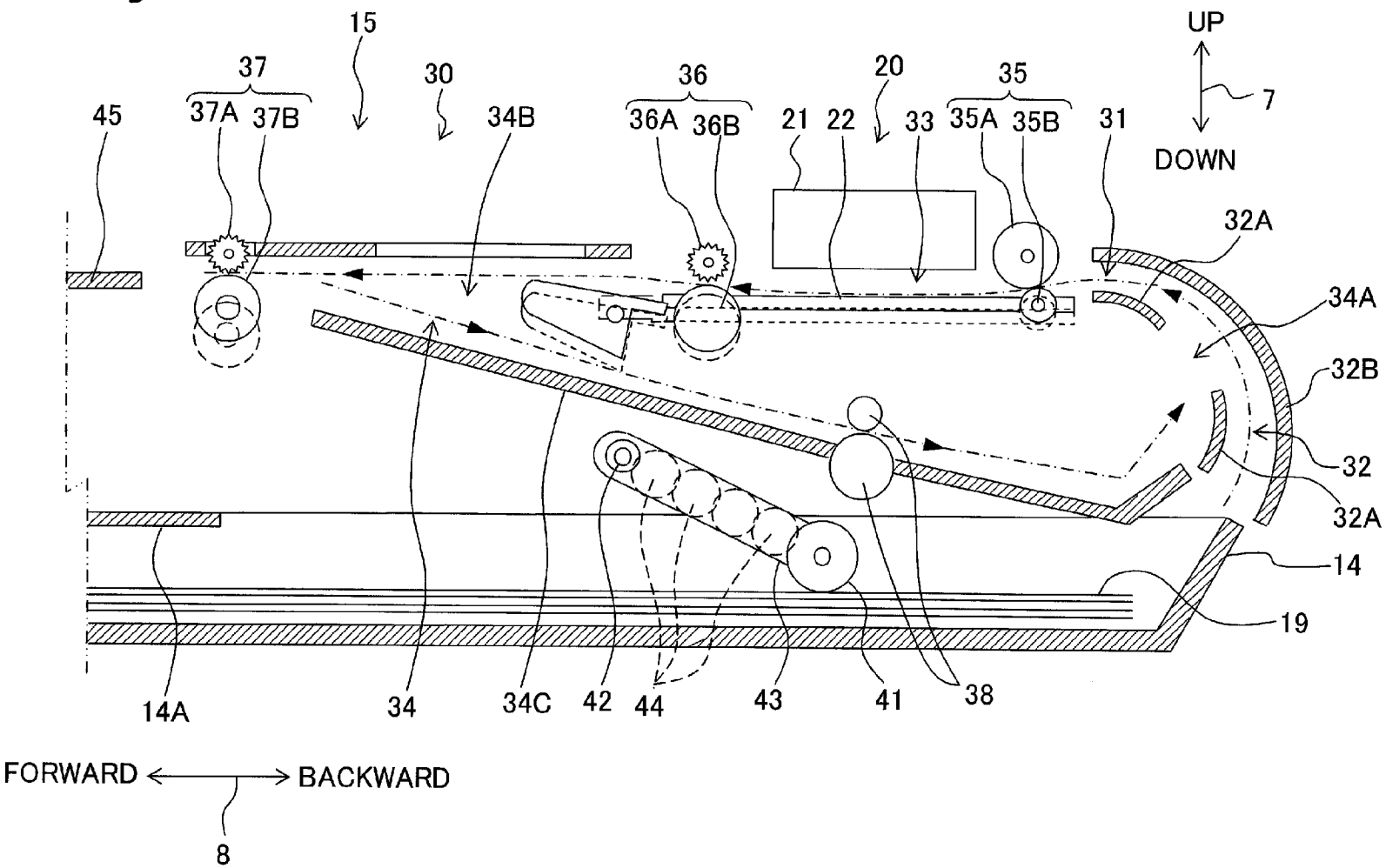
FIG. 2 is a schematic cross-sectional view of a printer section.

The printer section 15 includes, as shown in FIG. 2, a transporting device 30 which transports the first recording medium 19 and the above-described tray, and a recording section 20 which records the image to the transported recording medium. The transporting device 30 directly transports the first recording medium 19 and transports the second recording medium together with the tray, as will be described later. The first recording medium 19 and the tray correspond to a "transportation-objective medium (medium)" which is transported by the transporting device.

[Recording Section 20]

Figure 3:
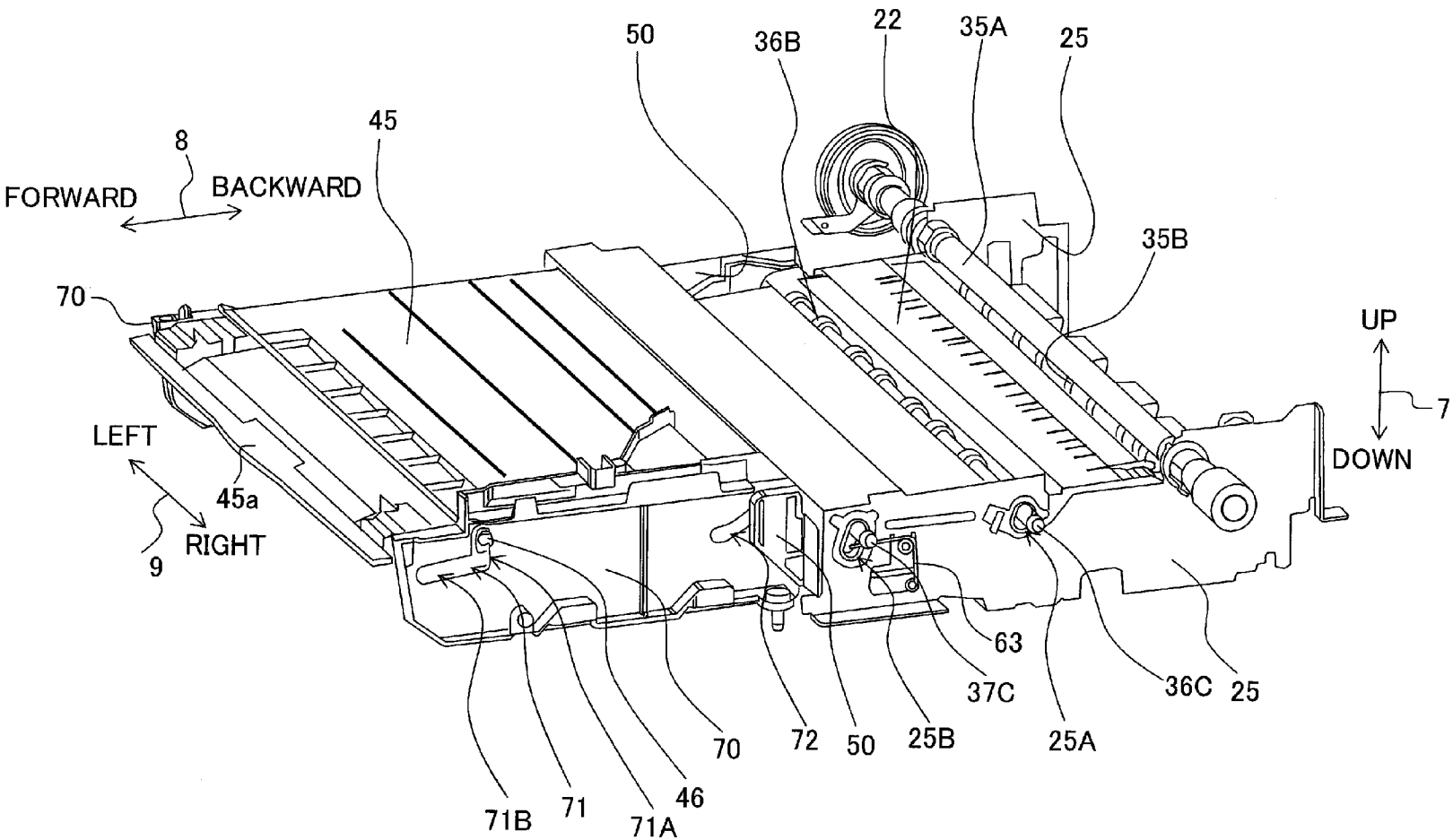
FIG. 3 is a perspective view of the printer section.

The recording section 20 includes a plate-shaped platen 22 mounted in an upper space of a rear portion of the paper feeding cassette 14, a recording head 21 disposed in an upper space of the platen 22 in a facing manner, a not-shown rail which supports the recording head 21 slidably in the right and left direction 9, a not-shown driving section which drives a movable member such as a recording head 21, and first frames 25 and second frames 70 shown in FIG. 3 which support the driving section and so on. The driving section is constituted, for example, by a plurality of drive motors and a drive transmitting mechanism which transmits a driving force of the drive motor to the movable member.

[Recording Head 21]

The recording head 21 includes a nozzle having a jetting port which opens downward, and as a result that the nozzle is deformed by a piezoelectric element or the like, an ink drop is jetted from the jetting port toward the platen 22 below. Further, the recording head 21 is moved along the right and left direction 9 by the above-described driving section. As will be described later, the first recording medium 19 and the tray are transported on the platen 22 toward the front. As a result of transporting of the first recording medium 19 and the tray toward the front and moving of the recording head 21 along the right and left direction 9, the printer section 15 can record the image to almost the entire surfaces of the surfaces of the first recording medium 19 and the second recording medium. The recording head 21 together with the platen 22 forms a part of a later-described transporting path 31 and is also a part of the transporting device 30. The platen 22 will be described later.

[First Frame 25]

First frames 25 are disposed, as shown in FIG. 3, in both right and left sides of the platen 22 respectively, fixed to the printer casing 11, and support the platen 22 as will be described later. Each of first frames 25 is provided with long holes 25A, 25B through which a supporting shaft 36C of a paper discharging roller 36B and a supporting shaft 37C of a switch-back roller 37B which will be described later are put, respectively. The long holes 25A, 25B are formed in a track shape which is long in the up and down direction 7, and have constitutions in which the supporting shafts 36C, 37C are movable in the up and down direction 7.

[Second Frame 70]

Second frames 70 are disposed in both right and left sides of a later-described tray guide 45 which is disposed in the front of the platen 22 respectively, and are fixed to the printer casing 11. Each of the second frames 70 is provided with a front and rear pair of guide groove holes 71, 72 through which later-described support protrusions 46 which the tray guide 45 has are put, respectively. The front side guide groove hole 71 includes a straight portion 71A provided along the up and down direction 7 and an inclined portion 71B which extends forward from a lower end of the straight portion 71A and is inclined as going toward the front. The rear side guide groove hole 72 becomes lower as going toward the front and is provided so that an lower end thereof is in the same position in terms of heights as a lower end of the inclined portion 71B of the guide groove hole 71. The right and left pair of second frames 70 support the tray guide 45 movably in the forward and backward direction 8, by the guide groove holes 71, 72.

[Transporting device 30]

The transporting device 30 which the printer section 15 has includes later-described respective members forming the transporting path 31 of FIG. 2, link plates 50 shown in FIG. 3 to FIG. 6B for expanding the transporting path 31, and a paper feeding roller 41 which transmits the first recording medium 19 placed on the feeding cassette 14 to the transporting path 31.

[Paper Feeding Roller 41]

The paper feeding roller 41 is disposed in the upper space of the rear portion of the paper feeding cassette 14 as shown in FIG. 2 and is supported by using a supporting shaft 42 and an arm 43. The supporting shaft 42 is supported rotatably around its center axis by the first frame 25 and so on, and is rotated by the above-described driving section. The arm 43 has a constitution in which in one end thereof the paper feeding roller 41 is installed rotatably around its center axis, the other end thereof is supported rotatably by the supporting shaft 42, and a plurality of transmission gears 44 which transmits a rotation of the supporting shaft 42 to the paper feeding roller 41 is provided between the one end and the other end. The paper feeding roller 41 contacts the first recording medium 19 placed on the paper feeding cassette 14 as a result that the arm 43 is rotated around the supporting shaft 42, is rotated as a result that the supporting shaft 42 is rotated, and, by being rotated, transmits the first recording medium 19 to the transporting path 31 explained below.

[Transporting Path 31]

The transporting path 31 is constituted, as shown in FIG. 2, by a first transporting path 32 with an arc-shaped cross section, one end thereof being positioned above a rear end portion of the paper feeding cassette 14 and the other end thereof being positioned in the rear of the platen 22, a second transporting path 33 with straight cross section, passing between the platen 22 and the recording head 21, and a reverse transporting path 34 passing below the platen 22 and connecting the first transporting path 32 and the second transporting path 33. The first transporting path 32 is formed, as shown in FIG. 2, of an inner guide member 32A and an outer guide member 32B each formed in an arc shape and facing each other in a radial direction. The inner guide member 32A is provided with a connection opening 34A to which one end of the reverse transporting path 34 is connected. The reverse transporting path 34 is for double-sided printing of the first recording medium 19, is formed of a guide member 34C disposed in a lower space of the platen 22 and a double-sided roller pair 38 annexed to the guide member 34C, and has a constitution in which the other end thereof is connected to the second transporting path 33 explained below.

[Second Transporting Path 33]

The second transporting path 33 is formed, as shown in FIG. 2, of the above-described recording head 21 and platen 22, a transporting roller pair 35 disposed nearer to a rear end portion of the platen 22, a paper discharging roller pair 36 disposed nearer to a front end portion of the platen 22, and a switch-back roller pair 37 disposed in the front of the paper discharging roller pair 36. A connection opening 34B to which the other end described above of the reverse transporting path 34 is connected is provided between the switch-back roller pair 37 and the paper discharging roller pair 36. The second transporting path 33 corresponds to a "transporting path" which is expandable in the up and down direction 7 as will be described later.

[Transporting Roller Pair 35]

The transporting roller pair 35 disposed nearer to the rear end portion of the platen 22 is constituted, as shown in FIG. 2, by an upper-side transporting roller 35A and a lower-side first facing roller 35B. The upper-side transporting roller 35A is supported rotatably centering on its center axis by the first frame 25 as shown in FIG. 3, and is rotated by the above-described driving section. The lower-side first facing roller 35B is supported rotatably centering on its center axis by the platen 22. As will be described later, the platen 22 is movable in the up and down direction 7, and the first facing roller 35B moves integrally with the platen 22 between a seventh posture in which the first facing roller 35B contacts the upper-side transporting roller 35A and an eighth posture in which the first facing roller 35B is positioned lower than in the seventh posture. In other words, the transporting roller pair 35 has a constitution in which the second transporting path 33 can be expanded in the up and down direction 7. The first facing roller 35B in the seventh posture in which the first facing roller 35B contacts the transporting roller 35A is pressed to the transporting roller 35A as a result that the platen 22 is biased upward by a first spring 28 shown in FIG. 6A and FIG. 6B, as will be described later.

[Paper Discharging Roller Pair 36]

The paper discharging roller pair 36 disposed nearer to the front end portion of the platen 22 is constituted, as shown in FIG. 2, by an upper-side second facing roller 36A and a lower-side paper discharging roller 36B. The upper-side second facing roller 36A is supported rotatably centering on its center axis by the first frame 25 and so on. It should be noted that in FIG. 3 to FIG. 7B, illustration of the second facing roller 36A is omitted.

The paper discharging roller 36B is provided movably in the up and down direction 7 between a third posture in which the paper discharging roller 36B is supported by a later-described link plate 50 and contacts the second facing roller 36A and a fourth posture in which the paper discharging roller 36B is supported by the first frame 25 in a position lower than in the third posture. More specifically, a supporting shaft 36C of the paper discharging roller 36B is put through the above-described long hole 25A provided in the first frame 25 and abuts on a peripheral wall in a lower side of the long hole 25A and supported by the first frame 25 in the fourth posture. The paper discharging roller pair 36 corresponds to a "second member pair", the lower-side paper discharging roller 36B corresponds to a "second moving member", and the second facing roller 36A which is immovable in the up and down direction 7 being a moving direction of the paper discharging roller 36B corresponds to a "second fixed member", respectively. Further, the paper discharging roller 36B is biased upward by a later-described second spring 62 in the third posture in which the paper discharging roller 36B contacts the second facing roller 36A and is pressed to the second facing roller 36A. The paper discharging roller 36B is rotated by the above-described driving section.

[Platen 22]

Figure 4:
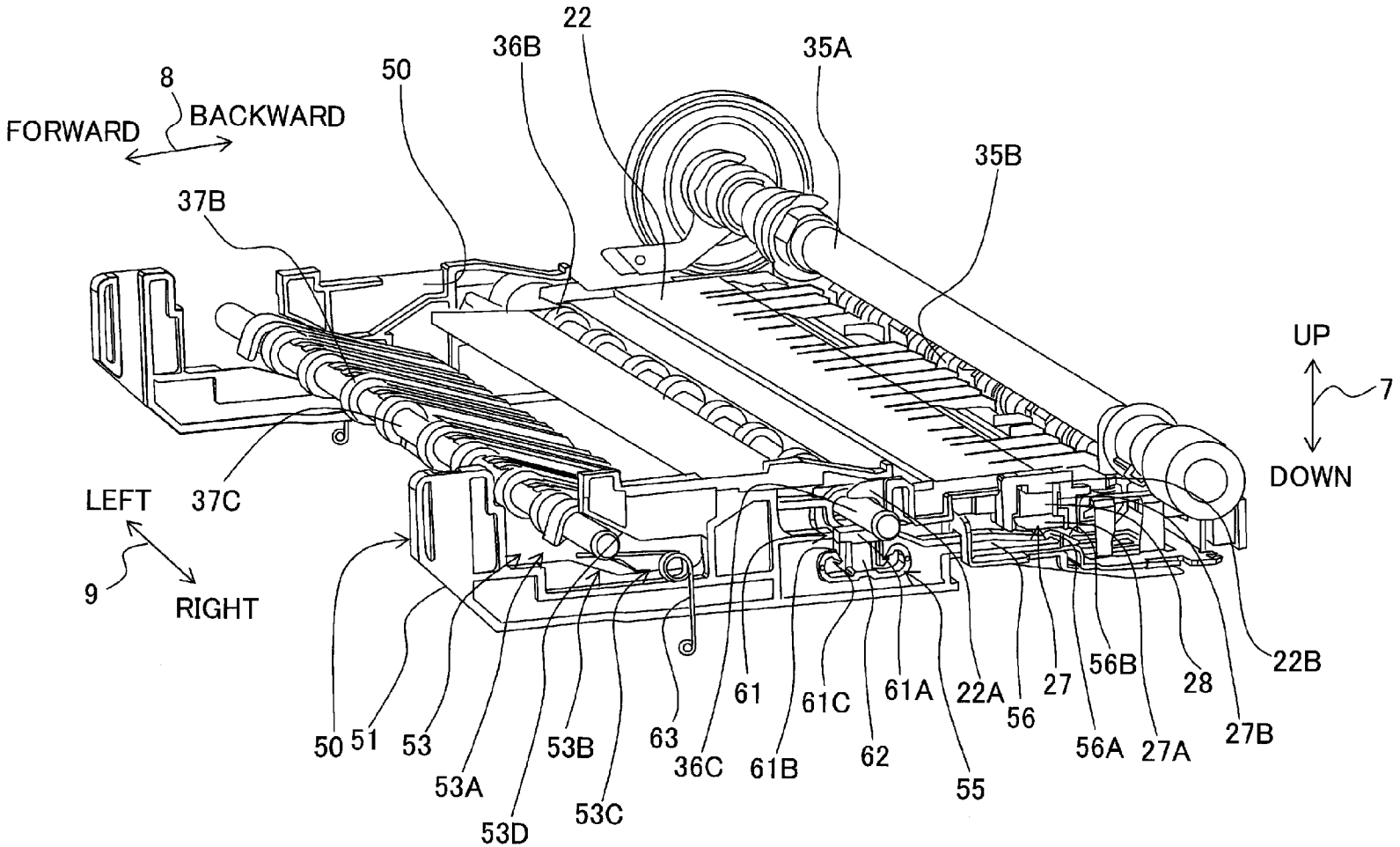
FIG. 4 is a perspective view of a transporting device.
Figure 5:
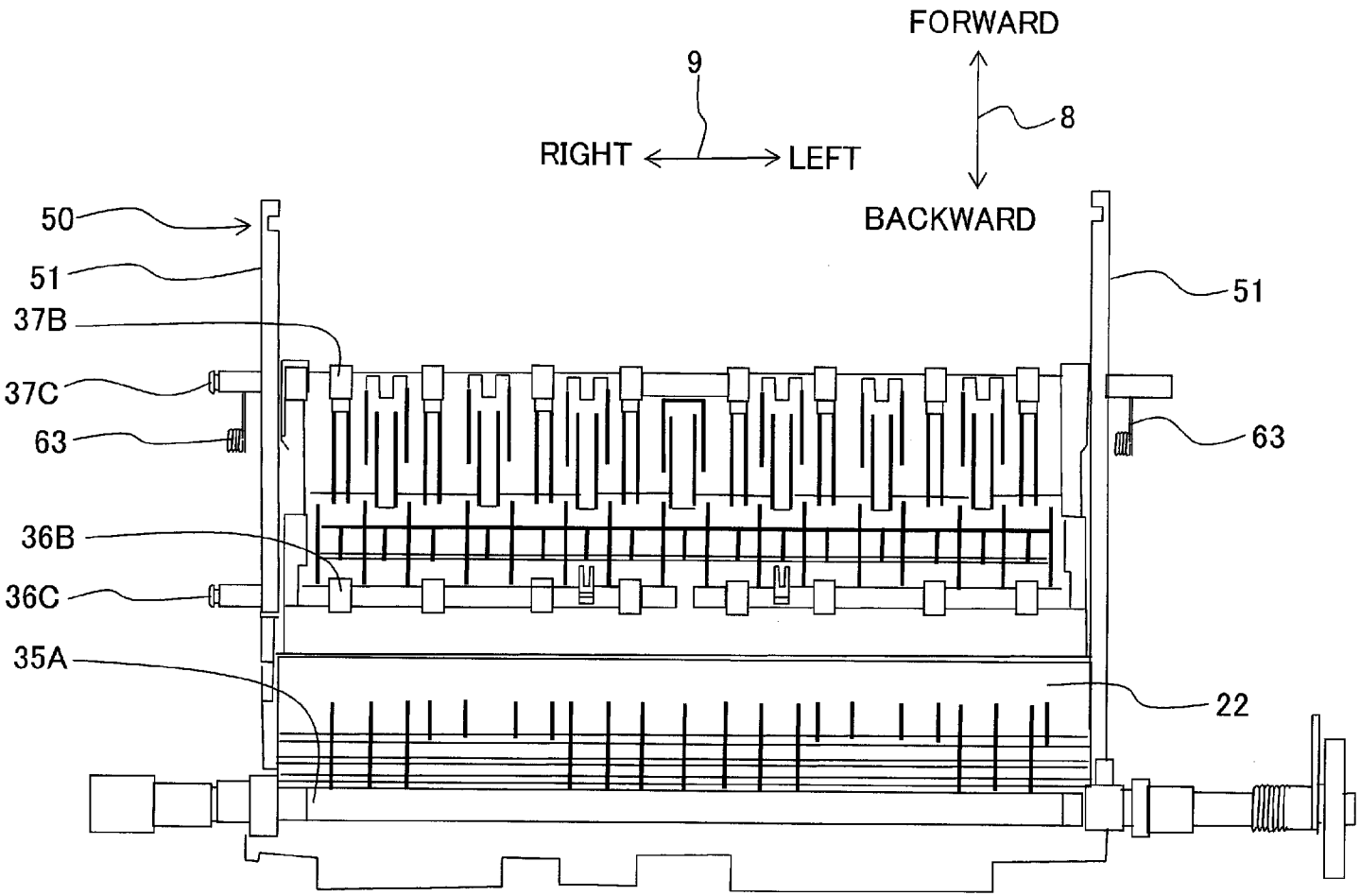
FIG. 5 is a plan view of the transporting device.
Figure 6A:
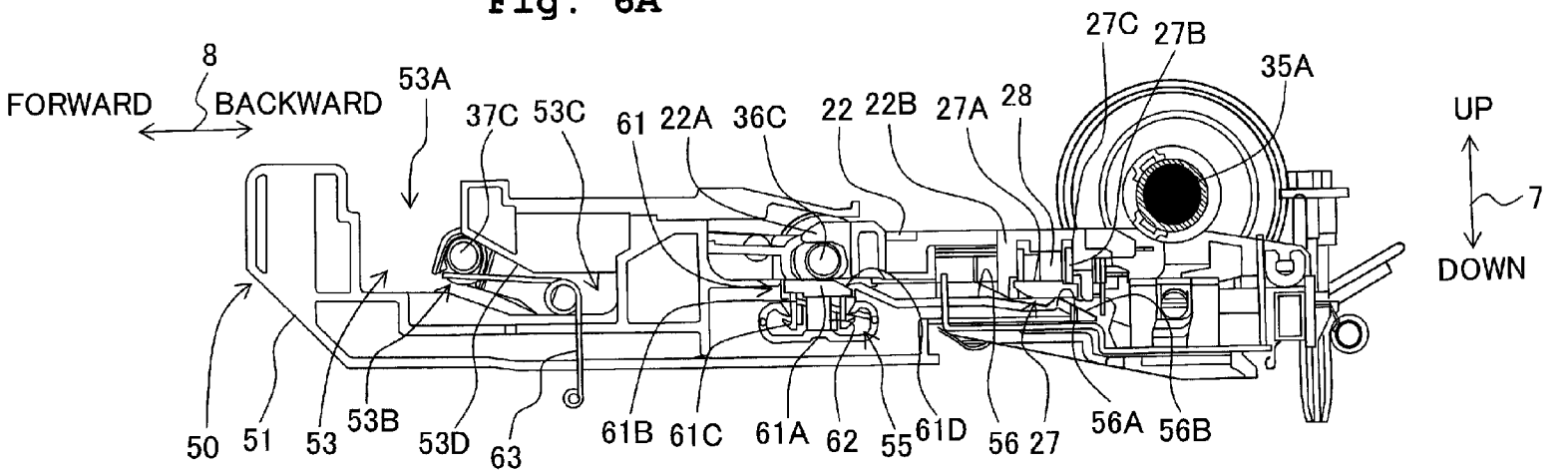
FIG. 6A is a side view of the transporting device in a state where a link plate is in an initial posture and FIG. 6B is a side view of the transporting device in a state where the link plate is in an expanded posture.
Figure 6B:
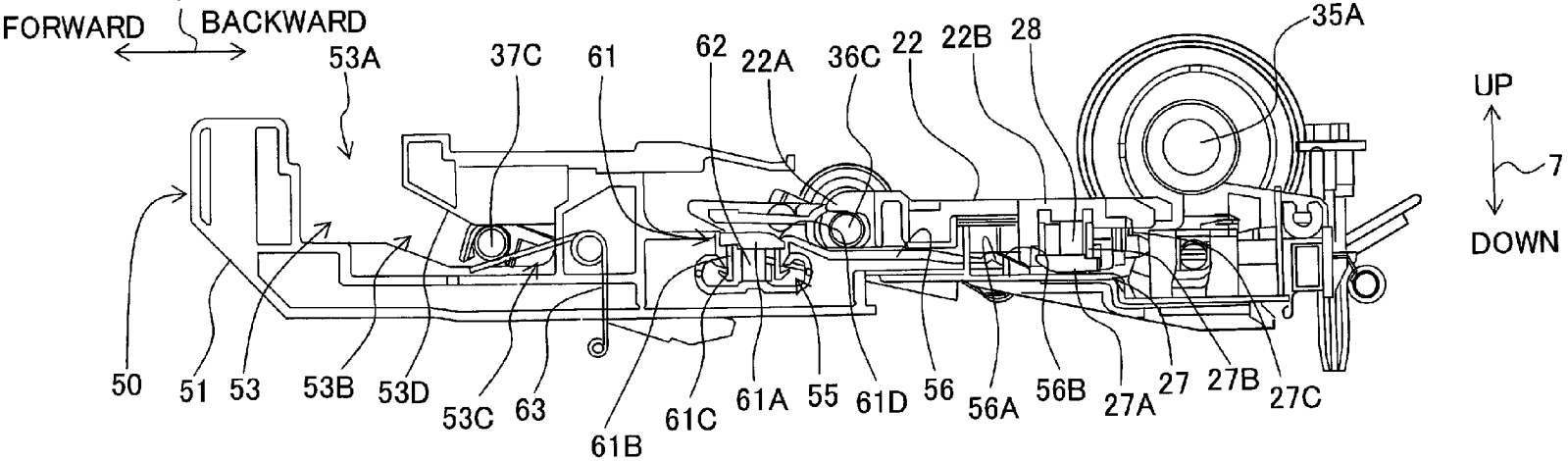

Both right and left end portions of the front end portion of the plate-shaped platen 22 are provided, as shown in FIG. 4, FIG. 6A and FIG. 6B, with a right and left pair of support protrusions 22A to be mounted on both end portions in the right and left direction 9 of the supporting shaft 36C of the paper discharging roller 36B. In other words, the platen 22 is supported in a front portion by the supporting shaft 36C of the paper discharging roller 36B, and the front portion is movable in the up and down direction 7 with the paper discharging roller 36B. The rear portion of the platen 22 is also provided movably in the up and down direction 7 as will be described later. The platen 22 moves between a ninth posture in which the first facing roller 35B contacts the transporting roller 35A and the paper discharging roller 36B contacts the second facing roller 36A, and a tenth posture in which the first facing roller 35B becomes apart from the transporting roller 35A and the paper discharging roller 36B becomes apart from the second facing roller 36A. Hereinafter, a constitution in which the rear portion of the platen 22 is movable will be explained.

Nearer to rear portions of the both right and left portions of the platen 22, there are respectively provided installation portions 22B to which later-described first spring holders 27 are installed. The first spring holder 27 integrally includes a holder portion 27A disposed below the installation portion 22B, a front and rear pair of installation pieces 27B which protrude from both front and rear end portions of the holder portion 27A upward toward the installation part 22B, and a hook claw 27C which is provided in a tip portion of the installation piece 27B and hooks on the installation portion 22B. The first spring holder 27 moves in the up and down direction 7 in relation to the platen 22 with a position at which the hook claw 27C hooks on the installation portion 22B being a lower limit position. The first spring 28 is disposed between the holder portion 27A of the first spring holder 27 and the installation portion 22B of the platen 22. The first spring 28 biases the installation portion 22B upward in relation to the holder portion 27A. As a result that the holder portion 27A is supported by the link plate 50 as will be described later, the rear portion of the platen 22 is supported by the first spring holder 27 in a state of being biased upward by the first spring 28. When the link plate 50 is moved by the user and the first spring holder 27 loses support by the link plate 50 as will be described later, the rear portion of the platen 22 together with the front portion becomes lower due to its own weight and the platen 22 is supported by the first frame 25 in the tenth posture. A moving distance of the platen 22 is set to become almost the same as a thickness size of the tray. Therefore, when the platen 22 is in the tenth posture, the tray can be transported by the transporting roller pair 35 and the paper discharging roller pair 36.

[Switch-back Roller Pair 37]

The switch-back roller pair 37 disposed in the front of the platen 22 is constituted, as shown in FIG. 2, by an upper-side third facing roller 37A and a lower-side switch-back roller 37B. The upper-side third facing roller 37A is supported rotatably centering on its center axis by the first frame 25 and so on. It should be noted that in FIG. 3 to FIG. 7B, illustration of the third facing roller 37A is omitted. The lower-side switch-back roller 37B is supported rotatably centering on its center axis by the later-described link plate 50, and is rotated by the above-described driving section. Further, the switch-back roller 37B is supported movably in the up and down direction 7 by the later-described link plate 50 and moves along the up and down direction 7 between a first posture in which the switch-back roller 37B contacts the upper-side third facing roller 37A and a second posture positioned below the first posture. The switch-back roller pair 37 corresponds to a "first member pair", the switch-back roller 37B corresponds to a "first moving member", and the third facing roller 37A which is immovable in the up and down direction 7 being a moving direction of the switch-back roller 37B corresponds to a "first fixed member", respectively. It should be noted that a moving distance of the switch-back roller 37B is set in a manner that a clearance size between the switch-back roller 37B and the third facing roller 37A is larger than the thickness size of the tray.

One of both right and left end portions of the supporting shaft 37C of the switch-back roller 37B is each put through the long hole 25B of each of the first frames 25, and one end of a right and left pair of torsion coil springs 63 shown in FIG. 3 abuts on the both end portions, respectively. The torsion coil spring 63, whose center portion and the other end are supported by the first frame 25, biases the supporting shaft 37C upward by the above-described one end. The torsion coil spring 63 corresponds to a "first biasing member". As a result that the supporting shaft 37C is biased upward by the torsion coil spring 63, the switch-back roller 37B in the first posture is pressed to the third facing roller 37A. The switch-back roller 37B pressed to the third facing roller 37A is rotated by the above-described driving section, thereby transporting the first recording medium 19. The switch-back roller 37B transports the first recording medium 19 forward at a time of single-sided printing, thereby discharging the first recording medium 19 to a paper discharging portion 14A of FIG. 2 provided in the paper feeding cassette 14, and transports the first recording medium 19 toward the rear, thereby transporting the first recording medium 19 to the reverse transporting path 34. The first recording medium 19 having advanced in the reverse transporting path 34 is returned from the first transporting path 32 to the second transporting path 33, passes on the platen 22 in a state where front and rear surfaces are reversed, and the image is recorded to the reverse surface. The switch-back roller pair 37 is able to switch a direction of transporting the first recording medium 19. Next, a constitution in which the image is recorded to the second recording medium will be explained.

[Tray Guide 45]

The tray guide 45 supporting the tray on which the second recording medium is placed is formed, as shown in FIG. 3, in a plate shape in which a thickness direction is the up and down direction 7, and is disposed in the front of the switch-back roller 37B. A front and rear pair of support protrusions 46 protrude from right and left side surfaces of the tray guide 45, respectively. The respective support protrusions 46 are put through the above-described guide groove holes 71, 72 provided in the second frame 70, respectively. A front end portion of the tray guide 45 is exposed to the outside from the above-described recess 11A provided in the printer casing 11. The user grasps the front end portion of the tray guide 45, and after lowering the front end portion downward, draws the front end portion forward. The above-described tray is placed by the user on the drawn tray guide 45. Further, the tray guide 45 is coupled with the below-described link plate 50 and has a function to move the link plate 50 along the forward and backward direction 8. The tray guide 45 and the link plate 50 correspond to "movable members". Further, the front end portion of the tray guide 45 corresponds to a "grip portion".

[Link Plate 50]

The link plate 50 includes, as shown in FIG. 4, FIG. 6A, FIG. 6B, FIG. 7A, and FIG. 7B, a right and left pair of base portions 51 each formed in a plate shape in which the right and left direction 9 is a thickness direction. Each of the base portions 51 is disposed between the platen 22 and the first frame 25 in the right and left direction 9, respectively, and is supported movably in the forward and backward direction 8 by the first frame 25, and, with a front end portion thereof being coupled with the tray guide 45, has a constitution to be movable in the forward and backward direction 8 between the initial posture in the rear shown in FIG. 6A and the expanded posture in the forward shown in FIG. 6B. That is to say, the link plate 50 moves in conjunction with an operation to make a state where the tray can be placed. The initial posture corresponds to a "fifth posture", while the expanded posture corresponds to a "sixth posture". Further, the up and down direction 7 being a direction in which the paper discharging roller 36B and the switch-back roller 37B perform posture change (change the posture) corresponds to a "first direction", while the forward and backward direction 8 in which the link plate 50 slides corresponds to a "second direction". In other words, in this embodiment, the first direction and second direction are orthogonal.

Figure 7A:
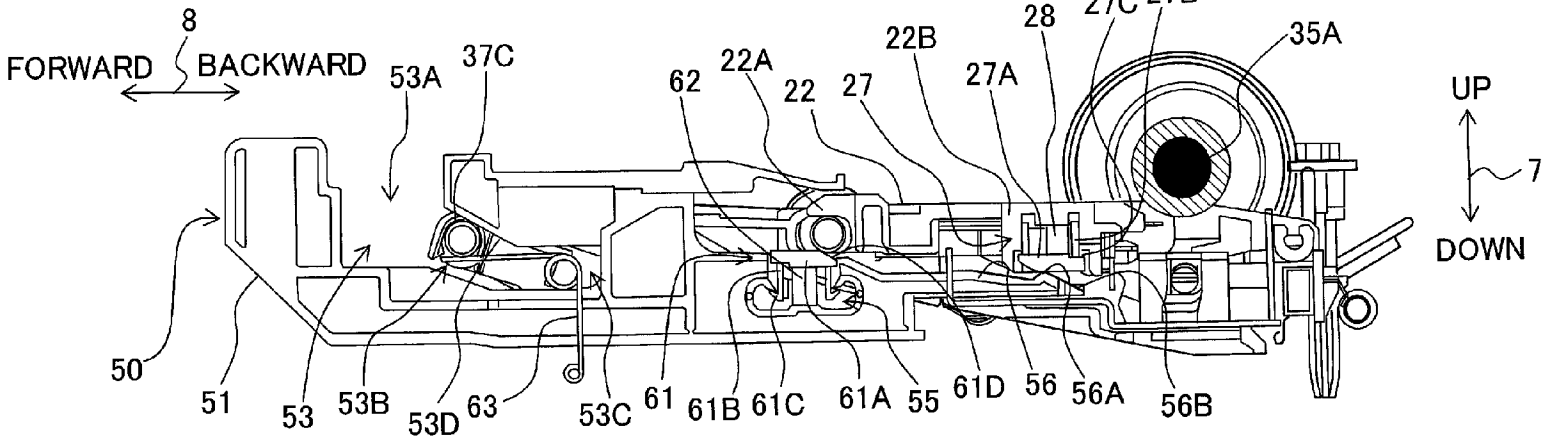
FIG. 7A and FIG. 7B are side views of the transporting device in the process of posture change of the link plate from the initial posture to the expanded posture, FIG. 7A showing a state where the link plate is nearer to a position of the initial posture and FIG. 7B showing a state where the link plate is nearer to a position of the expanded posture.
Figure 7B:
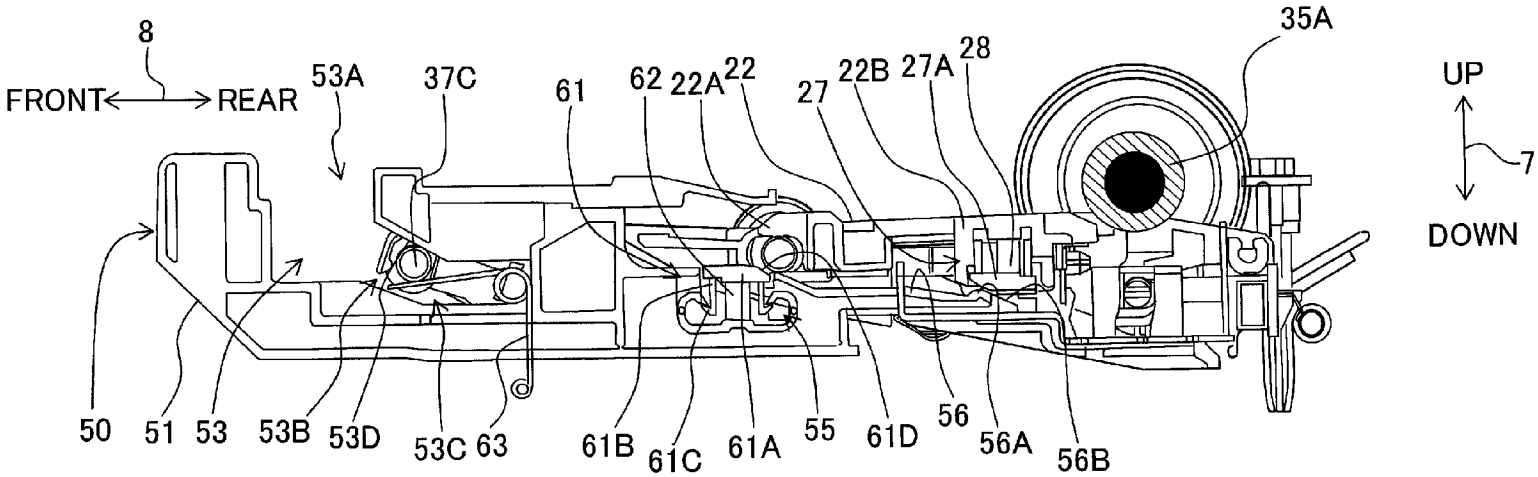

Hereinafter, a constitution in which the link plate 50 supports the switch-back roller 37B movably will be explained. In the front portions of the right and left pair of base portions 51 of the link plates 50, as shown in FIG. 4, FIG. 6A, FIG. 6B, FIG. 7A, and FIG. 7B, there are provided guide groove holes 53 through which end portions in the right and left direction 9 of the supporting shaft 37C of the switch-back roller 37B are put, respectively. The guide groove hole 53 includes an opening portion 53A which is opened upward, an inclined portion 53B provided in the rear of the opening portion 53A, and a straight portion 53C provided in the rear of the inclined portion 53B. An inclined surface 53D being an upper-side circumferential surface of the inclined portion 53B is inclined downward as going toward the rear. The inclined surface 53D is formed of one to a plurality of flat surface(s) or curved surface(s), for example. In an illustrated example, the inclined surface 53D is formed of almost one flat surface. The straight line portion 53C extends straight from the inclined portion 53B toward the rear. The guide groove hole 53 is provided, as shown in FIG. 6A, in a position at which the switch-back roller 37B can be placed in a front end portion of the inclined portion 53B when the link plate 50 is in the initial posture in the rear. When the link plate 50 is in the initial posture in the rear, the switch-back roller 37B, which is biased upward by the above-described torsion coil spring 63, is pressed to the third facing roller 37A and the upper-side inclined surface 53D. As shown in FIG. 7A, when the link plate 50 moves toward the front from the initial posture in the rear with the tray guide 45, the switch-back roller 37B which is pressed to the inclined surface 53D by the torsion coil spring 63 is pressed downward while slide-contacting the inclined surface 53D as shown in FIG. 7B, and reaches the straight line portion 53C as shown in FIG. 6B. In other words, the switch-back roller 37B performs posture change from the first posture to the second posture. The base portion 51 provided with the inclined portion 53B corresponds to a "first abutting portion", while the upper-side inclined surface 53D corresponds to a "first inclined surface". That is to say, the inclined surface 53D being the first inclined surface is provided in a side of the third facing roller 37A being the first fixed member in relation to the switch-back roller 37B being the first movable member.

Next, a constitution in which the link plate 50 moves the paper discharging roller 36B will be explained. Each of the base portions 51 of the link plate 50 includes in a rear portion, as shown in FIG. 4, FIG. 6A, FIG. 6B, FIG. 7A, and FIG. 7B, a reversed T-shaped doventail groove 55 opened upward. The doventail groove 55 is provided in a position which is directly below the supporting shaft 36C of the paper discharging roller 36B when the link plate 50 is in the initial posture. Each of the doventail grooves 55 respectively houses second spring holder 61. The second spring holder 61 integrally includes a holder portion 61A provided in an upper portion of the doventail groove 55, a front and rear pair of installation pieces 61B respectively protruding downward from both the front and rear end portions of the holder portion 61A, and a hook claw 61C provided in a lower end portion of the installation piece 61B and hooks on a peripheral wall of a lower portion of the doventail groove 55. The second spring holder 61 moves in the up and down direction 7 in relation to the base portion 51, with a position at which the hook claw 61C hooks on the peripheral wall of the doventail groove 55 as the upper limit position. A second spring 62 is disposed between the holder portion 61A disposed in the upper potion of the doventail groove 55 and an inner bottom surface (lower surface) of the doventail groove 55. The second spring holder 61 is biased upward in relation to the base portion 51 by the second spring 62. As shown in FIG. 6A, in a case when the link plate 50 is in the initial posture, the supporting shaft 36C of the paper discharging roller 36B contacts an upper surface of the holder portion 61A of the second spring holder 61 and the second spring holder 61 is positioned lower than the upper limit position. When the link plate 50 is in the initial posture, the paper discharging roller 36B is biased upward by the second spring 62 via the second spring holder 61, and when the paper discharging roller 36B is in the third posture in which the paper discharging roller 36B abuts on the second facing roller 36A, the paper discharging roller 36B is pressed to the second facing roller 36A. The second spring 62 corresponds to a "second biasing member".

As described above, since the second spring holder 61 is installed in the base portion 51 of the link plate 50, the second spring holder 61 slides integrally with the base portion 51 in the forward and backward direction 8. Here, in a rear portion of the holder portion 61A of the second spring holder 61A is provided with an inclined surface 61D which becomes lower as going toward the rear. When the link plate 50 in the initial posture is moved toward the front by the user as shown in FIG. 7A, the supporting shaft 36C of the paper discharging roller 36B slides on the inclined surface 61D as shown in FIG. 7B, and comes off from the second spring holder 61 as shown in FIG. 6B. The supporting shaft 36C which has lost support by the second spring holder 61 becomes lower due to its own weight and is supported by the first frame 25. The second spring holder 61 corresponds to a "second abutting portion", while the inclined surface 61D corresponds to a "second inclined surface". Here, a direction of a surface is defined as a direction rising perpendicularly from the surface, that is, a direction in which a perpendicular line having drawn in relation to the surface extends from the surface. In the inclined surface 53D being the first inclined surface, since a perpendicular line in relation to the inclined surface 53D extends diagonally left downward from the inclined surface 53D in FIG. 6A and FIG. 6B, a direction of the surface is diagonally left downward in FIG. 6A and FIG. 6B. Similarly, a direction of the surface of the inclined surface 61D being the second inclined surface is diagonally right upward. As described above, the first inclined surface and the second inclined surface are contrary to each other in terms of the directions of the surfaces.

Next, there will be explained a constitution in which the link plate 50 makes the rear portion of the platen 22 and the first facing roller 35B perform posture change. The link plate 50 includes, as shown in FIG. 4, FIG. 6A, FIG. 6B, FIG. 7A, and FIG. 7B, a right and left pair of support pieces 56 extending toward the rear from a rear end of each of the base portions 51. A rear end portion of the support piece 56 is provided, as shown in FIG. 6A, with a support projection portion 56A which contacts a lower surface of the holder portion 27A of the above-described first spring holder 27 installed in the installation portion 22B of the platen 22 in a case when the link plate 50 is in the initial posture. In other words, the link plate 50 supports the rear portion of the platen 22 by the support piece 56 via the first spring holder 27. A rear portion of the support projection portion 56A of the support piece 56 is provided with an inclined surface 56B. The inclined surface 56B is inclined downward as going toward the rear. When the link plate 50 moves toward the front from the initial posture as shown in FIG. 7A, the first spring holder 27 moves downward while sliding the inclined surface 56B as shown in FIG. 7B, and comes off from the support projection portion 56A as shown in FIG. 6B. As a result that the first spring holder 27 comes off from the support projection portion 56A, the platen 22 becomes lower due to its own weight, to the tenth posture.

[Printing Operation]

The initial posture of the link plate 50 is a posture for recording an image to the first recording medium 19 placed on the paper feeding cassette 14. In a case when the link plate 50 is in the initial posture, as described above, the first facing roller 35B is pressed to the transporting roller 35A, the paper discharging roller 36B is pressed to the second facing roller 36A, the switch-back roller 37B is pressed to the third facing roller 37A, and the platen 22 is in the ninth posture in which the platen 22 is apart from the recording head 21 by a predetermined distance. In the case when the link plate 50 is in the initial posture, if recording of the image in the first recording medium 19 is instructed, the above-described control section transmits the first recording medium 19 placed on the paper feeding cassette 14 to the first transporting path 32 by rotating the paper feeding roller 41. The transmitted first recording medium 19 is drawn from the first transporting path 32 to the second transporting path 33 by the transporting roller pair 35, transported through the second transporting path by the transporting roller pair 35 and the paper discharging roller pair 36, with the image being recorded to one surface or both surfaces, and discharged to the paper feeding cassette 14 by the switch-back roller 37B.

The expanded posture of the link plate 50 is a posture for recording an image to the second recording medium such as a CD and a DVD. When the tray guide 45 is drawn forward by the user and the link plate 50 performs posture change from the initial posture to the expanded posture, the first facing roller 35B, the platen 22, the paper discharging roller 36B, and the switch-back roller 37B which are members to form a lower side of the second transporting path 33 each move downward, and the second transporting path 33 is expanded in the up and down direction 7. The tray on which the second recording medium is placed, while supported by the tray guide 45, is inserted between the paper discharging roller pair 36 by the user. When recording of the image to the second recording medium is instructed, the above-described control section makes the paper discharging roller 36B and the first facing roller 35B rotate thereby to transport the tray toward the rear, and subsequently, makes the first facing roller 35B and the paper discharging roller 36B reverse-rotate thereby to transport the tray toward the front. The image is recorded to the second recording medium by the recording head 21 while the tray passes on the platen 22. As described above, since a moving distance of the platen 22 in the up and down direction 7 is set to be almost the same as the thickness size of the tray, a clearance distance between an upper surface of the second recording medium passing on the platen 22 and an opening surface of the nozzle of the recording head 21 is almost the same as a clearance distance between the first recording medium 19 passing on the platen 22 and the opening surface of the above-described nozzle. In other words, regardless of a difference between thicknesses of recording media, it is possible to record an image to the second recording medium similarly to the first recording medium. After recording of the image, the second recording medium is transported onto the tray guide 45 by the paper discharging pair 36.

When the link plate 50 in the expanded posture is returned to the initial posture by the user, the supporting shaft 37C of the switch-back roller 37B moves upward by a biasing force of the torsion coil spring 63 while slide-contacting the inclined surface 53D, the support projection portion 56A of the support piece 56 gets under the holder portion 27A to push up the first spring holder 27, and the second spring holder 61 gets under the supporting shaft 36C of the paper discharging roller 36B to push up the supporting shaft 36C. In other words, the switch-back roller 37B returns to the first posture, the platen 22 returns to the ninth posture, the first facing roller 35B returns to the seventh posture, and the paper discharging roller 36B returns to the third posture.

[Operation to Expand the Second Transporting Path]

As described above, as a result that the tray guide 45 is drawn forward by the user, the link plate 50 moves in the forward direction, and posture change from the initial posture shown in FIG. 6A to the expanded postured shown in FIG. 6B is performed. Then, the second transporting path 33 is expanded in the up and down direction 7.

Figure 8A:
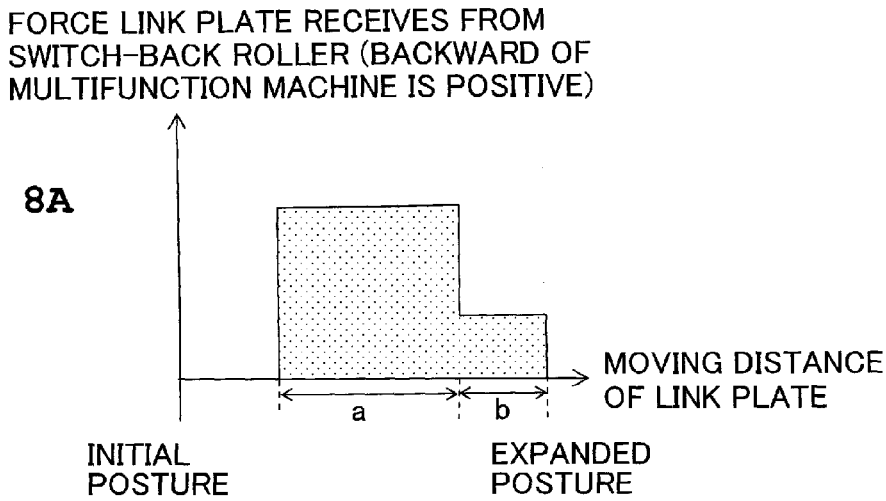
FIG. 8A to FIG. 8C are graphs showing a relationship between a moving distance (horizontal axis) of the link plate and a force (vertical axis) the link plate receives at a time of posture change of the link plate from the initial posture to the expanded posture.
Figure 8B:
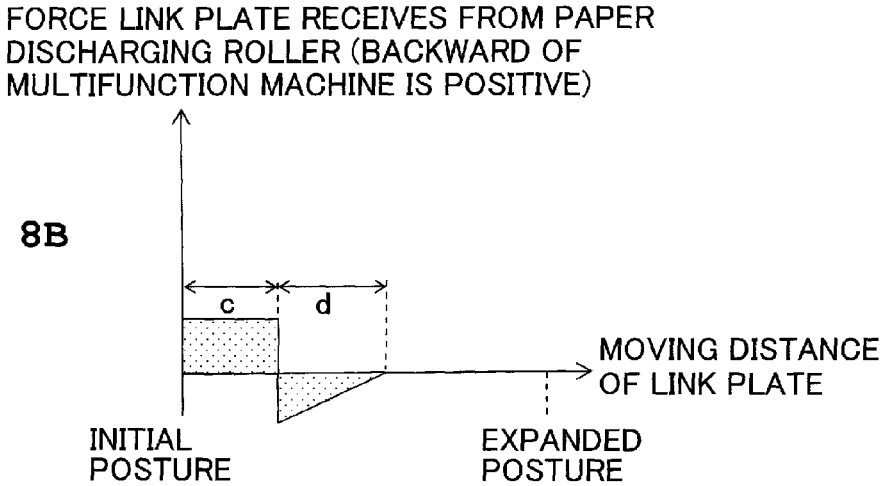
Figure 8C:
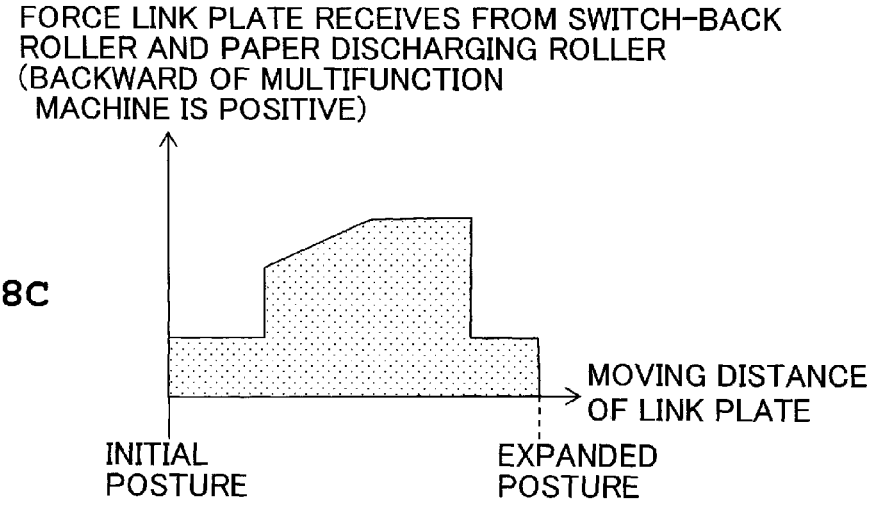

Forces the link plate 50 receives from the paper discharging roller 36B and the switch-back roller 37B at this time will be explained with reference to FIG. 8A to FIG. 8C. In FIG. 8A to FIG. 8C, a force in a direction opposite to a moving direction of the link plate 50 is shown as positive, in other words, a backward force is shown as positive.

The force the link plate 50 receives from the paper discharging roller 36B will be explained. As the link plate 50 moves forward, first, a friction force occurs between the supporting shaft 36C of the paper discharging roller 36B and the holder portion 61A of the second spring holder 61. This force is positive when the backward force is defined as positive, as indicated by c of FIG. 8B. Next, the supporting shaft 36C of the paper discharging roller 36B slide-contacts the inclined surface 61D and the paper discharging roller 36B performs posture change. Since the inclined surface 61D becomes lower as going toward the rear, the link plate 50, when moving, receives a forward force from the paper discharging roller 36B. In other words, the force (backward is positive) the link plate 50 receives from the paper discharging roller 36B is negative as indicated by d of FIG. 8B. It should be noted that when the link plate 50 being the movable member moves from the initial posture being the fifth posture to the expanded posture being the sixth posture, a direction of movement of the link plate 50 is forward, and thus it can be said that the paper discharging roller 36B being the second member pair generates a force in a direction the same as the direction of the movement of the link plate 50.

Next, the force the link plate 50 receives from the switch-back roller 37B will be explained. After the link plate 50 starts to move, the supporting shaft 37C of the switch-back roller 37B slide-contacts the inclined surface 53D, and the switch-back roller 36B performs posture change. Since the inclined surface 53D is provided in an above side of the supporting shaft 37C and becomes lower as going toward the rear, the link plate 50, when moving, receives a backward force from the switch-back roller 37B. In other words, the force (backward is positive) the link plate 50 receives from the switch-back roller 37B is positive as indicated by a of FIG. 8A. Subsequently, the supporting shaft 37C slide-contacts the link plate 50 within the straight line portion 53C of the guide groove hole 53, thereby generating a friction force. This friction force is positive as indicated by b of FIG. 8A, and is smaller than the force generated at the time that the above-described supporting shaft 37C slide-contacts the inclined surface 53D.

Therefore, with regard to the forces the link plate 50 receives from both of the paper discharging roller 36B and the switch-back roller 37B, a part of the force received from the paper discharging roller 36B and a part of the force received from the switch-back roller 37B balance out, and a resultant force of the force acting on the link plate 50 is reduced as shown in FIG. 8C. As a result, the user can easily move the link plate 50 and the tray guide 45, and usability of the multifunction machine 10 is improved. It should be noted that the force the link plate 50 receives from the platen 22 is also forward, and a part of the force the link plate 50 receives from the switch-back roller 37B balances off also a part of the force the link plate 50 receives from the platen 22. In other words, the platen 22 also corresponds to one of a "second member pair". It should be noted that when the link plate 50 being the movable member moves from the initial posture being the fifth posture to the expanded posture being the sixth posture, a direction of movement of the link plate 50 is forward, and thus it can be said that the switch-back roller 37B being the first member pair generates a force of a direction opposite to the direction of the movement of the link plate 50.

As described above, in this embodiment, the link plate 50 is provided with the inclined surface 53D (first inclined surface) and the inclined surface 61D (second inclined surface). Thereby, there is realized a transporting device capable of reducing a force to move the link plate 50 (movable member), by a simple constitution as an inclined surface.

Further, in this embodiment, by using the torsion coil spring 63 (first biasing member) which presses the switch-back roller 37B (first movable member) to the third facing roller 37A (first fixed member), and the second spring 62 (second biasing member) which presses the paper discharging roller 36B (second movable member) to the second facing roller 36A (second fixed member), the switch-back roller 37B and the third facing roller 37A can be respectively pressed to the inclined surface 53D (first inclined surface) and the inclined surface 61D (second inclined surface) which are provided in a manner that directions of incline are contrary to each other. As a result, it is possible to realize a transporting device capable of reducing the force to move the link plate 50, with a small number of components.

In this embodiment, the constitution in which the discharging roller 36B and the switch-back roller 37B perform posture change in almost the same period as shown in FIG. 8A to FIG. 8C is explained, but it suffices if a part of the period during which the paper discharging roller 36B is made to perform posture change and a part of the period during which the switch-back roller 37B is made to perform posture change overlap each other. Thereby, a force which acts on the link plate 50 is reduced.

Further, in a case when the inclined surface 53D, the inclined surface 56B, or the inclined surface 61D is formed of a curved surface or a plurality of flat surfaces in order that the force the link plate 50 receives from the switch-back roller 37B is not constant during a period during which the link plate 50 is slid and has a maximum vale, by a constitution in which the discharging roller 36B performs posture change when the force the link plate 50 receives from the switch-back roller 37B is the maximum, a maximum value of the force to move the link plate 50 can be reduced. In other words, the maximum value of the force to move the link plate 50 can be adjusted by inclination angles or disposition positions of the inclined surface 56B and the inclined surface 61D and an inclination angle or a disposition position of the inclined surface 53D, and, as a result, the maximum value of the force to move the link plate 50 can be adjusted by a simple constitution as a setting of an inclination angle or a disposition position.

Further, in the above-described embodiment, the constitution in which the second transporting path 33 is expanded as a result that the link plate 50 moves toward the front is explained, but a constitution in which the second transporting path 33 is expanded as a result that a link plate 50 moves toward the rear can also be adopted.

Further, in the above-described embodiment, the constitution in which the second recording medium is transported by the tray is explained, but a constitution in which a second recording medium is directly transported with the second recording medium itself being used as a transportation-objective medium can also be adopted.

Further, in the above-described embodiment, the constitution in which the link plate 50 is moved by the user is explained, but a constitution in which a link plate 50 is moved by a drive motor can also be adopted. The drive motor corresponds to a "drive source". The drive motor moves the link plate 50, for example, by rotating a roller or a belt provided in a manner to abut on the link plate 50. Since a force to move the link plate 50 can be reduced as described above, in the constitution in which the link plate 50 is moved by the drive motor, restriction on a specification of the drive motor regarding a torque is alleviated.

Further, it suffices if a part of the force the link plate 50 receives from the paper discharging roller 36B and a part of the force the link plate 50 receives from the switch-back roller 37B are in opposite directions in the moving direction of the link plate 50, and a constitution is possible in which a link plate 50, when moving, receives a backward force from a paper discharging roller 36B and receives a forward force from a switch-back roller 37B.

Further, though an example in which the second transporting path 33 is expanded as a result that the paper discharging roller 36B, the switch-back roller 37B, and the platen 22 perform posture change is explained, a member to perform posture change is not limited to the paper discharging roller 36B or the like but can be the transporting roller 35B or another member.

Further, the first facing roller 35A can be supported by a member other than the platen, for example, a holder or the like. If the first facing roller 35A is supported by the holder, the holder is constituted to change its posture by movement of a link plate 50, similarly to the first spring holder 27.

[Second Embodiment]

In the embodiment, the operation to return the expanded second transport path to the initial state in the transporting device 30 of the first embodiment will be explained. In the operation, the posture of the paper discharging roller pair 36 and the platen 22 are changed in a time-shift manner, thereby making it possible to reduce the force acting on the link plate 50. In the embodiment, the platen 22 and recording head 21 correspond to a "first member pair"; the ninth posture and a tenth posture of the platen22 correspond to a "a first posture" and "a second posture", respectively; the paper discharging roller pair 36 corresponds to a "second member pair"; the third posture and the fourth posture of the paper discharging roller pair 36 correspond to a "third posture" and a "fourth posture", respectively; the support peace 56 corresponds to a "first abutting portion"; the inclined surface 56B corresponds to a "first inclined surface"; the second spring holder 61 corresponds to a "second abutting portion"; the inclined surface 61D corresponds to a "second inclined surface" and the expanded posture and the initial posture of the link plate 50 correspond to a "fifth posture" and a "sixth posture", respectively.

Figure 9A:
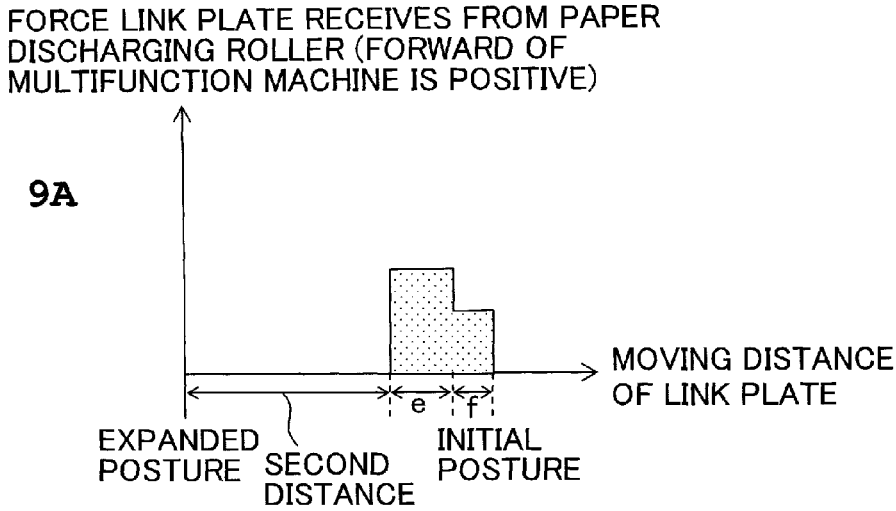
FIG. 9A to FIG. 9C are graphs showing a relationship between a moving distance(horizontal axis) of the link plate and a force (vertical axis) the link plate receives at a time of posture change of the link plate from the expanded posture to the initial posture.
Figure 9B:
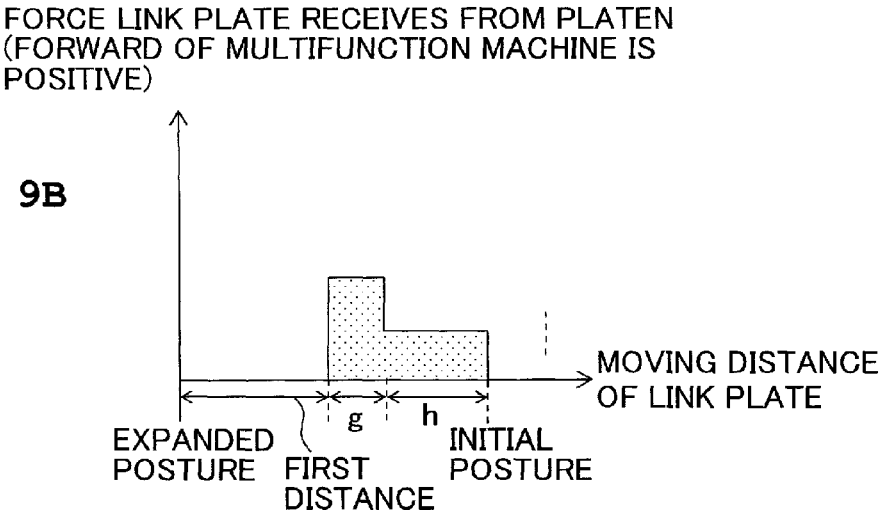
Figure 9C:
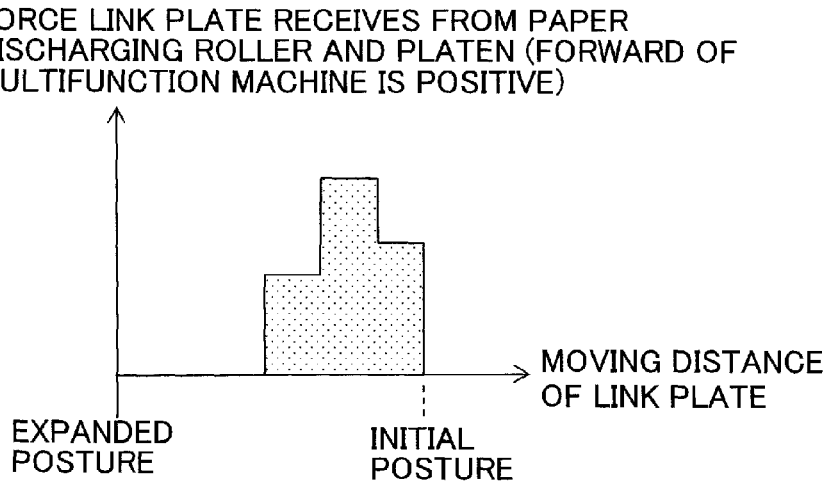

As a result that the user moves the tray guide 45 backward, the link plate 50 moves backward, thereby performing posture change from the expanded posture shown in FIG. 6B to the initial posture shown in FIG. 6A. Then, the second transporting path 33 having been expanded in the up and down direction 7 returns to the initial state. Forces the link plate 50 receives from the paper discharging roller 36B and the platen 22 at this time will be explained by using FIG. 9A to FIG. 9C. In FIG. 9A to FIG. 9C, a force in a direction opposite to a direction of movement of the link plate 50 is shown as positive, that is, a forward force is shown as positive. In this embodiment, it is constituted so that the force to move the link plate 50 is reduced by performing posture change of the paper discharging roller 36B and the platen at different times. In this embodiment, the platen 22 and the recording head 21 correspond to a "third member pair", the support piece 56 corresponds to a "third abutting portion", and the inclined surface 56B corresponds to a "third inclined surface".

The force the link plate 50 receives from the paper discharging roller 36B will be explained. After the link plate 50 starts to move backward, first, the supporting shaft 36C of the paper discharging roller 36B and the inclined surface 61D of the second spring holder 61 slide-contact, and the paper discharging roller 36B performs posture change. As described above, since the inclined surface 61D becomes lower as going toward the rear, the link plate 50, when moving, receives a forward force from the paper discharging roller 36B. When the forward force is defined as positive, this force is positive as indicated by e of FIG. 9A. Next, the paper discharging roller 36B slide-contacts the holder portion 61A of the holder 61, thereby generating a friction force therebetween. This friction force is positive as indicated by f of FIG. 9A, and is smaller than the force generated at the time that the above-described supporting shaft 36C and the inclined surface 61D slide-contact.

Next, the force the link plate 50 receives from the platen 22 will be explained. As described above, the platen 22 is supported by the first spring holder 27. After the link plate 50 starts to move backward, the first spring holder 27 slide-contacts the inclined surface 56B of the support piece 56 provided in the link plate 50, and the platen 22 performs posture change. Since the inclined surface 56B is inclined as going toward the rear, the link plate 50, when moving, receives a forward force from the platen 22. Namely, the force (forward is positive) the link plate 50 receives from the platen 22 is positive as indicated by g of FIG. 9B. Subsequently, the holder portion 27A of the first spring holder 27 slide-contacts on the support projection portion 56A, thereby generating a friction force. This friction force is positive as indicated by h of FIG. 9B, and is smaller than the force generated at the time that the above-described first spring holder 27 slide-contacts the inclined surface 56B.

In this embodiment, a length size in the forward and backward direction 8 of the holder portion 61A of the second spring holder which supports the supporting shaft 36C of the paper discharging roller 36B is set in a manner that the supporting shaft 36C reaches the inclined surface 61D after the inclined surface 56B of the link plate 50 comes off from the first spring holder 27. In other words, the paper discharging roller 36B starts to perform posture change after the platen 22 performs posture change as shown in FIG. 9A and FIG. 9B. Consequently, the force which acts on the link plate 50 is dispersed in terms of time, and in a case when the link plate 50 is returned from the expanded posture to the initial posture as shown in FIG. 9C, the force to move the link plate 50 is reduced, which enables the user to move the link plate 50 easily. It should be noted that in the case when the link plate 50 moves from the expanded posture to the initial posture, a moving distance of the link plate 50 while the first spring holder 27 reaches the inclined surface 56B of the support projection portion 56A corresponds to a "first distance", and a moving distance of the link plate 50 while the supporting shaft 36C of the paper discharging roller 36B reaches the inclined surface 61D of the second spring holder 61 corresponds to a "second distance", and the length size in the forward and backward direction 8 of the holder portion 61A or a length size in the forward and backward direction 8 of the support projection portion 56A is set in a manner that the second distance becomes larger than the first distance. As described above, in the transporting device of this embodiment, by a simple constitution as a positional relationship between the second spring holder 61 (second abutting portion) and the support piece (first abutting portion) along the moving direction, the force which acts on the link plate 50 (movable member) is dispersed in terms of time, whereby the force to move the link plate 50 (movable member) can be reduced.

Further, in this embodiment, when the link plate 50 (movable member) performs posture change from the expanded posture to the initial posture, the spring holder 61 (second abutting portion) and the support piece 56 (first abutting portion) both generate a component of a force opposite to the direction of the movement (positive direction). Since the spring holder 61 (second abutting portion) and the support piece 56 (first abutting portion) generate components of the forces in the same direction, the spring holder 61 and the support piece 56 can have similar constitutions, which enables to simplify constitutions. In other words, it is possible to realize a transporting device which has a simple constitution and which is capable of reducing a force to move a movable member.

Further, in this embodiment, the spring holder 61 (second abutting portion) has the inclined surface 61D (second inclined surface), while the support piece 56 (first abutting portion) has the inclined surface 56B (first inclined surface). A simple constitution such as an inclined surface enables movement of the link late 50 (movable member) along the forward and backward direction 8 (second direction) to be changed to movement along the up and down direction 7 (first direction) thereby to make the platen 22 and the paper discharging roller pair 36 perform posture change.

In this embodiment, the constitution to make the paper discharging roller 36B perform posture change after making the platen 22 perform posture change is explained, but a constitution to make a platen 22 perform posture change after making a paper discharging roller 36B perform posture change can also be adopted. It should be noted that the switch-back roller 37B can be made to perform posture change with the platen 22, can be made to perform posture change with the paper discharging roller 36B, and can be made to perform posture change independently of the platen 22 or the paper discharging roller 36B.

Further, there is explained the constitution in which the paper discharging roller 36B starts to perform posture change after the platen 22 completes posture change as shown in FIG. 9A to FIG. 9C, but a constitution can also be adopted in which a link plate 50 starts to make a paper discharging roller 36B perform posture change at a time that a force the link plate 50 receives from a platen 22 is reduced. In other words, "after performing posture change" includes both meanings of "after posture change is completely finished" and "after posture change of a member to be made perform posture change first is started and after a force a link plate 50 receives from that member is reduced".

As described above, the second spring holder 61 can be provided in a position at which the second spring holder 61 abuts on the paper discharging roller pair before the platen 22 completes posture change, but it is desirable that as in this embodiment the second spring holder 61 is provided in a position at which the spring holder 61 abuts on the paper discharging roller pair 36 after the platen 22 completes posture change. It is because an effect to reduce the force to move the link plate 50 (movable member) can be heightened.

Further, in this embodiment, the constitution in which the second transporting path 33 is expanded by sliding of the link plate 50 is explained, but a constitution can also be adopted in which a rotation body which is rotatable is used instead of the link plate 50 and a second transporting path 33 is expanded by rotation of this rotation body. For example, a platen rotor which is rotated by a rotation body is provided in a printer casing 11 as a first abutting portion, a transporting roller rotor which is rotated by the rotation body is provided in a printer casing 11 as a second abutting portion, and an idle rotation region which is not rotated even if the rotation body is rotated is provided in the transporting roller rotor, whereby a force a link plate 50 receives from a paper discharging roller 36 and a force the link plate 50 receives from a platen 22 can be dispersed in terms of time. As a technique for providing the transporting roller rotor with the idle rotation region, a known technique is used.

In the first embodiment, although the operation to expand the second transporting path is explained, the same effect is caused in the operation to return the expanded second transport path to the initial state. In tins case, the expanded posture and the initial posture of the link plate 50 correspond to a "fifth posture" and a "sixth posture" of the movable member, respectively; the paper discharging roller pair 36 corresponds to a "first member pair" and the switch-back roller pair 37 corresponds to a "second member pair". The switch-back roller 37B generates a force in a direction as the same direction of the movement of the link plate 50 (the backward force). Therefore, the force to move the link plate 50 can be reduced.

On the other hand, in the second embodiment, the operation to return the expanded second transport path to the initial state is explained. However, in the operation to expand the second transporting path, the postures of the paper discharging roller pair 36 and the platen 22 can be changed in a time-shift manner. In this case, the paper discharging roller pair 36 and the platen 22 generate a force in a direction as the same direction of the movement of the link plate 50 (the forward force). The force which acts on the link plate 50 is dispersed in terms of time, and the force to move the link plate 50 can be reduced uniformly.

It is also allowable that the transporting device 30 and the multifunction machine 10 (the image recording apparatus) of the first embodiment also achieve the same effect as the effect of the second embodiment. Further, it is also allowable that the transporting device 30 and the multifunction machine 10 (the image recording apparatus) of the second embodiment also achieve the same effect as the effect of the first embodiment.

What is claimed is:

1. A transporting device transporting a medium, comprising:

a first member pair which is apart from each other with a distance in a first direction, and which faces each other to define a part of a transporting path through which the medium is transported, and which changes a posture of the first member pair between a first posture and a second posture in which the distance is different from the distance in the first posture;

a second member pair which is apart from each other with a distance in the first direction, which faces each other in a position different from that of the first member pair to define a part of the transporting path, and which changes a posture of the second member pair between a third posture and a fourth posture in which the distance is different from the distance in the third posture; and a movable member which is movable between a fifth posture and a sixth posture along a second direction intersecting the first direction, and which has a first abutting portion which abuts on one of the first member pair and a second abutting portion which abuts on one of the second member pair, wherein, in a process that the movable member moves from the fifth posture to the sixth posture, the first abutting portion abuts on one of the first member pair and makes the first member pair change the posture from the first posture to the second posture, thereby generating a force in a direction opposite to a direction of movement from the fifth posture to the sixth posture; and while the first abutting portion makes the first member pair change the posture, the second abutting portion abuts on one of the second member pair and makes the second member pair change the posture from the third posture to the fourth posture, thereby generating a force in a same direction as the direction of movement from the fifth posture to the sixth posture.

2. The transporting device according to claim 1, wherein the second abutting portion is disposed in the movable member so that the second abutting portion abuts on one of the second member pair in the process that the movable member moves from the fifth posture to the sixth posture and when the force generated by the first abutting portion has a maximum value.

3. The transporting device according to claim 1, wherein the first abutting portion comprises a first inclined surface which intersects the second direction and which abuts on one of the first member pair in the process that the movable member moves from the fifth posture to the sixth posture; and the second abutting portion comprises a second inclined surface which intersects the second direction and is contrary to the first inclined surface in terms of a direction of a surface, and which abuts on one of the second member pair in the process.

4. The transporting device according to claim 3, wherein the first member pair comprises a first moving member which changes a posture and a first fixed member which is fixed in a moving direction of the first moving member;

the second member pair comprises a second moving member which changes a posture and a second fixed member which is fixed in a moving direction of the second moving member;

the first inclined surface is disposed in a first fixed member side of the first moving member; and the second inclined surface is disposed in a side opposite to a second fixed member side of the second moving member, the transporting device comprising:

a first biasing member which biases the first moving member to the first fixed member side, in a state where the first moving member abuts on the first inclined surface; and a second biasing member which biases the second moving member to the second fixed member side, in a state where the second moving member abuts on the second inclined surface.

5. The transporting device according to claim 1, wherein a grip portion is provided in one end side of the movable member.

6. The transporting device according to claim 1, further comprising a drive source to move the movable member.

7. The transporting device according to claim 1, wherein the first direction and the second direction are orthogonal.

8. The transporting device according to claim 1, further comprising a third member pair which is apart from each other with a distance in a first direction, and which faces each other in a position different from those of the first member pair and the second member pair to define a part of the transporting path, and which changes a posture of the third member pair between a seventh posture and a eighth posture in which the distance is different from the distance in the seventh posture;

wherein the movable member further has a third abutting portion which abuts on one of the third member pair;

in a process that the movable member moves from the sixth posture to the fifth posture, the third abutting portion abuts on one of the third member pair and makes the third member pair change the posture from the eighth posture to the seventh posture; and after the third abutting portion makes the third member pair change the posture from the eighth posture, the second abutting portion abuts on one of the second member pair and makes the second member pair change the posture from the fourth posture.

9. An image recording apparatus comprising:

the transporting device according to claim 1; and a recording section which records an image to the medium transported through the transporting path.

10. The image recording apparatus according to claim 9, comprising:

a recording head which jets ink toward the medium; and a platen which faces the recording head to define a part of the transporting path and supports the medium, wherein the first member pair is a switch-back roller pair which switches a direction of transporting the medium;

the second member pair is a paper discharging roller pair which discharges the medium, on which the ink has been jetted, from the part of the transporting path defined by the recording head and the platen; and the movable member is a link plate which has abutting portions which abut on one of the switch-back roller pair and one of the paper discharging roller pair.

11. The image recording apparatus according to claim 9, wherein the first member pair is a switch-back roller pair which switches a direction of transporting the medium;

the second member pair includes a recording head which jets ink toward the medium, and a platen which supports the medium; and the movable member is a link plate which has abutting portions which abut on one of the switch-back roller pair and the platen.

12. A transporting device transporting a medium, comprising:

a first member pair which is apart from each other with a distance in a first direction, and which faces each other to define a part of a transporting path through which the medium is transported, and which changes a posture of the first member pair between a first posture and a second posture in which the distance is different from the distance in the first posture;

a second member pair which is apart from each other with a distance in the first direction, which faces each other in a position different from that of the first member pair to define a part of the transporting path, and which changes a posture of the second member pair between a third posture and a fourth posture in which the distance is different from the distance in the third posture; and a movable member which is movable between a fifth posture and a sixth posture and which has a first abutting portion which abuts on one of the first member pair and a second abutting portion which abuts on one of the second member pair;

wherein, in a process that the movable member moves from the fifth posture to the sixth posture, the first abutting portion abuts on one of the first member pair and makes the first member pair change the posture from the first posture to the second posture; and after the first abutting portion makes the first member pair change the posture from the first posture, the second abutting portion abuts on one of the second member pair and makes the second member pair change the posture from the third posture.

13. The transporting device according to claim 12, wherein the second abutting portion is disposed in the movable member so that the second abutting portion abuts on one of the second member pair in the process that the movable member moves from the fifth posture to the sixth posture and after the first member pair changes the posture to the second posture.

14. The transporting device according to claim 12, wherein the first abutting portion and the second abutting portion are provided integrally with the movable member;

when the movable member is in the fifth posture, a first distance from the first abutting portion along a moving direction of the movable member in relation to the first member pair in the first posture is smaller than a second distance from the second abutting portion along the moving direction in relation to the second member pair in the third posture.

15. The transporting device according to claim 12, wherein the first abutting portion, when making the first member pair change the posture from the first posture, generates a force in a direction opposite to a direction of movement of the movable member from the fifth posture to the sixth posture; and the second abutting portion, when making the second member pair change the posture from the third posture, generates a force in a direction opposite to the direction of the movement.

16. The transporting device according to claim 12, wherein the movable member moves in a second direction intersecting the first direction;

the first abutting portion comprises a first inclined surface which intersects the second direction and which makes the first member pair change the posture by abutting on one of the first member pair by the movement of the movable member; and the second abutting portion comprises a second inclined surface which intersects the second direction and which makes the second member pair change the posture by abutting on one of the second member pair by the movement of the movable member.

17. An image recording apparatus comprising:

the transporting device according to claim 12; and a recording section which records an image to the medium transported through the transporting path.

18. The image recording apparatus according to claim 17, wherein the first member pair includes a recording head which jets ink toward the medium, and a platen which faces the recording head to define a part of the transporting path and supports the medium;

the second member pair is a paper discharging roller pair which discharges the medium, on which the ink has been jetted, from the part of the transporting path defined by the recording head and the platen; and the movable member is a link plate which has abutting portions which abut on the platen and one of the paper discharging roller pair.

* * * * *